US005806920A

United States Patent [19]

Blount

[11] Patent Number: 5,806,920

[45] **Date of Patent: *Sep. 15, 1998**

[54] FULLY RECLINABLE ELEVATOR LIFT CHAIR WITH OTTOMAN

[76] Inventor: Eric D. Blount, Rte. 2 Box 254, Calhoun City, Miss. 38916

[ * ] Notice: The term of this patent shall not extend beyond the expiration date of Pat. No. 5,520,439.

[21] Appl. No.: 612,265

[22] Filed: Mar. 7, 1996

Related U.S. Application Data

[63] Continuation-in-part of Ser. No. 340,842, Nov. 17, 1994, Pat. No. 5,520,439.

[51] Int. Cl.[6] ..... A47C 1/02

[52] U.S. Cl. ..... 297/68; 297/85; 297/330; 297/DIG. 10; 297/362.11

[58] Field of Search ..... 297/DIG. 10, 330, 297/362.11, 68, 71, 85

[56] References Cited

U.S. PATENT DOCUMENTS

| | | | |
|---|---|---|---|
| 5,024,486 | 6/1991 | Auel | 297/DIG. 10 |
| 5,094,508 | 3/1992 | Bathrick et al. | 297/DIG. 10 |
| 5,219,204 | 6/1993 | Bathrick et al. | 297/DIG. 10 |

*Primary Examiner*—Peter R. Brown
*Assistant Examiner*—Anthony D. Barfield

[57] ABSTRACT

A lift chair being movable between reclining and forward lifting positions. The lift chair comprises a chair portion and a back portion, a base member having an upper surface that defines a first mating surface and sub-frame assembly, supporting the chair portion, having a front portion, a rear portion, and a second mating surface that is engagable with the first mating surface. The sub-frame assembly being movably connected to the base member proximate to the front thereof and further comprising a rotatable beam rotatably connected to the rear thereof having a back support member to which is attached the back portion. A n ottoman, movable between extended and retracted positions, is provided and is associated with the base member. A motor, associated with the base member and linked to both the rotatable beam and the ottoman is used to move the lift chair between a first position wherein the sub-frame assembly is inclined forward relative to vertical, a second position wherein the second mating surface engages the first mating surface and the ottoman is in the retracted position, and a third position wherein the second mating surface continues to engage the first mating surface, the back portion is reclined rearwardly relative to vertical, and the ottoman is in the extended position.

15 Claims, 6 Drawing Sheets

FULLY RECLINABLE ELEVATOR LIFT CHAIR WITH OTTOMAN

RELATED APPLICATION

This application is a continuation-in-part of U.S. application Ser. No. 08/340,842, filed on Nov. 17, 1994, now U.S. Pat. No. 5,520,439, and entitled "Fully Reclinable Elevator Lift Chair".

BACKGROUND OF THE INVENTION

This invention relates to lift chairs and, more particularly, to a reclinable, elevator or lift chair including an ottoman for use by invalids, elderly, disabled and/or injured persons.

In the care of such persons, there is commonly employed a chair having an occupant assisting feature in the form of a mechanical or electromechanical mechanism that powers the chair upwardly and forwardly to assist the occupant in moving from a sitting position to a standing position.

An example of a typical chair lift mechanism currently in use may be found in U.S. Pat. No. 5,165,753, issued Nov. 24, 1992, to Eldred D. Henderson, for an "Elevator Chair Apparatus" which is hereby incorporated by reference in its entirety. The '753 patent discloses a lift chair or elevator chair apparatus which is provided with a base portion having an inclined upper surface and a sub-frame assembly pivotally attached thereto along a forward edge. A mechanical ram powered by an electric motor pivots the sub-frame with respect to the base and about the forward pivot. The inclined upper surface of the base receives the sub-frame thereon in a fully downward position and defines the extreme reclined position. Pivotal rotation of the sub-frame with respect to the base and upon the pivot to an uppermost position defines the forward most lifting position. Throughout the moving process the chair remains rigid as the back is fixedly attached to the chair. Thus, the back of the chair is unable to attain a reclined position. Therefore, a need exists for a lift chair having improved flexibility in design whereby the occupant may achieve a fully reclined rest position. Furthermore, during the lifting process, the back, owing to its rigidity with respect to the frame, maintains a fixed angle with respect to the seat which makes sitting in the chair or exiting therefrom problematic. Therefore, a further need exists for a chair whereby the back portion may maintain a substantially vertical orientation in the raised position for allowing ease of use by an occupant.

Reclining chairs of the non-lifting type often allow for tilting of the back relative to the seat portion of the chair through the use of complex linking mechanisms. An example of one such chair of the motorized variety may be found in U.S. Pat. No. 4,365,836 issued to Jackson et al. on Dec. 28, 1982. The '836 patent discloses a seat which is coupled to a stationary frame by two quadrilateral linkages, one on each side of the chair. As known, the more complex the linking mechanism the more costly the chair. Therefore, a further need exists for a simplified and less costly linking mechanism for allowing the back to move relative to the seat in a reclinable chair during both the reclining and elevating operations.

As a result of these existing needs, it is an object of the present invention to provide a simplified and less costly motorized lifting chair of the type with a rotatable back.

It is a further object of the present invention to provide such a chair with an ottoman attachment for providing the user with an elevatable foot rest for use in the reclined positions.

SUMMARY OF THE INVENTION

In accordance with the present invention, a lift chair being movable between reclining and forward lifting positions is provided. The lift chair generally comprises a chair portion and a back portion, a base member having an upper surface that defines a first mating surface and a sub-frame assembly, supporting the chair portion, having a front portion, a rear portion, and a second mating surface that is engagable with the first mating surface. The sub-frame assembly being movably connected to the base member proximate to the front thereof and further comprising a rotatable beam rotatably connected to the rear thereof having a back support member to which is attached the back portion. An ottoman, movable between extended and retracted positions, is provided and is associated with the base member. A motor, associated with the base member and linked to both the rotatable beam and the ottoman is used to move the lift chair between a first position wherein the sub-frame assembly is inclined forward relative to vertical, a second position wherein the second mating surface engages the first mating surface and the ottoman is in the retracted position, and a third position wherein the second mating surface continues to engage the first mating surface, the back portion is reclined rearwardly relative to vertical, and the ottoman is in the extended position. The lift chair includes A better understanding of the objects, advantages, features, properties and relationships of the invention will be obtained from the following detailed description and accompanying drawings which set forth illustrative embodiments and are indicative of the various ways in which the principles of the invention may be employed.

BRIEF DESCRIPTION OF THE DRAWINGS

For a better understanding of the invention, reference may be had to the embodiments shown in the following drawings in which.

DETAILED DESCRIPTION

Figure 1:
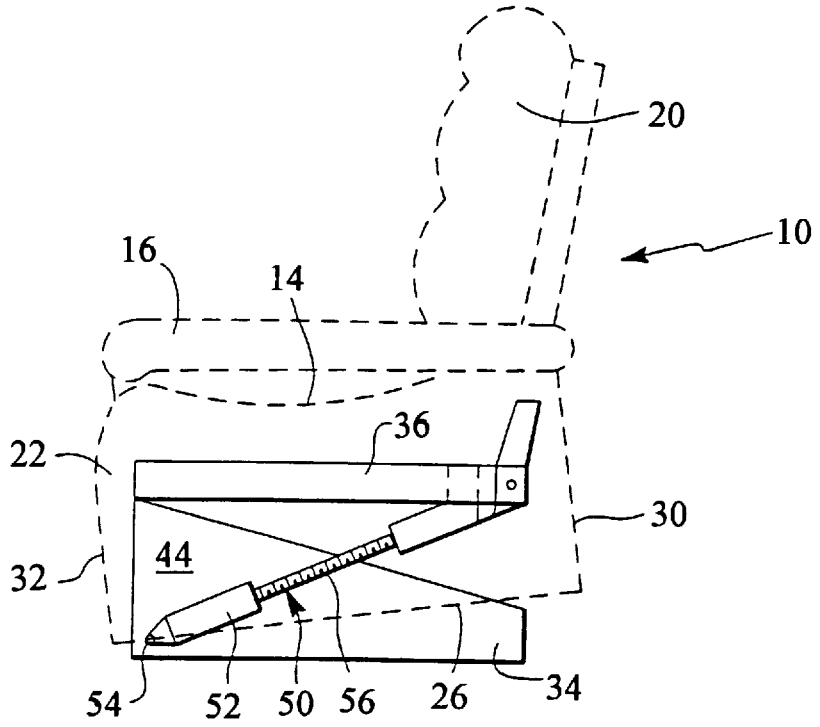
FIG. 1 illustrates a side view of a first embodiment of the present invention in a slightly raised position.
Figure 2:
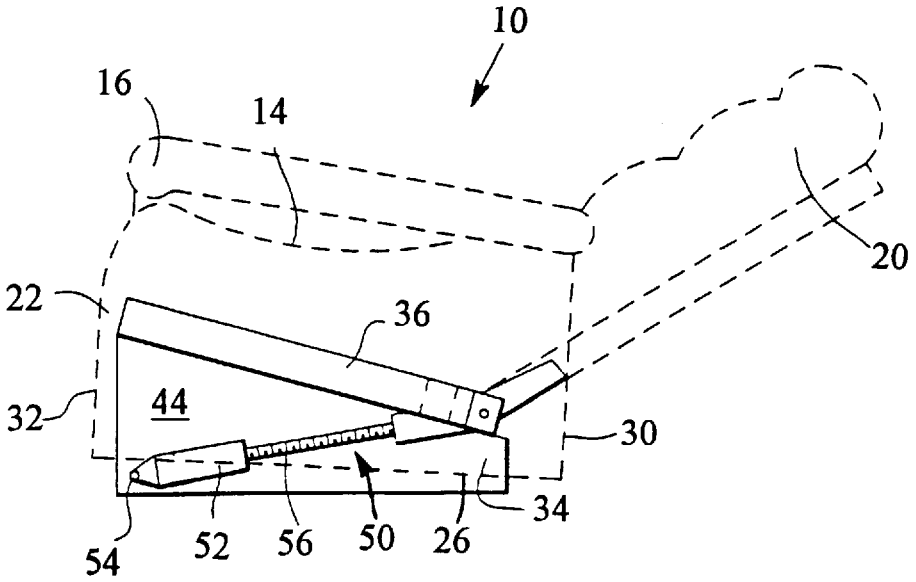
FIG. 2 illustrates a side view of the invention shown in FIG. 1 in the fully reclined position.
Figure 3:
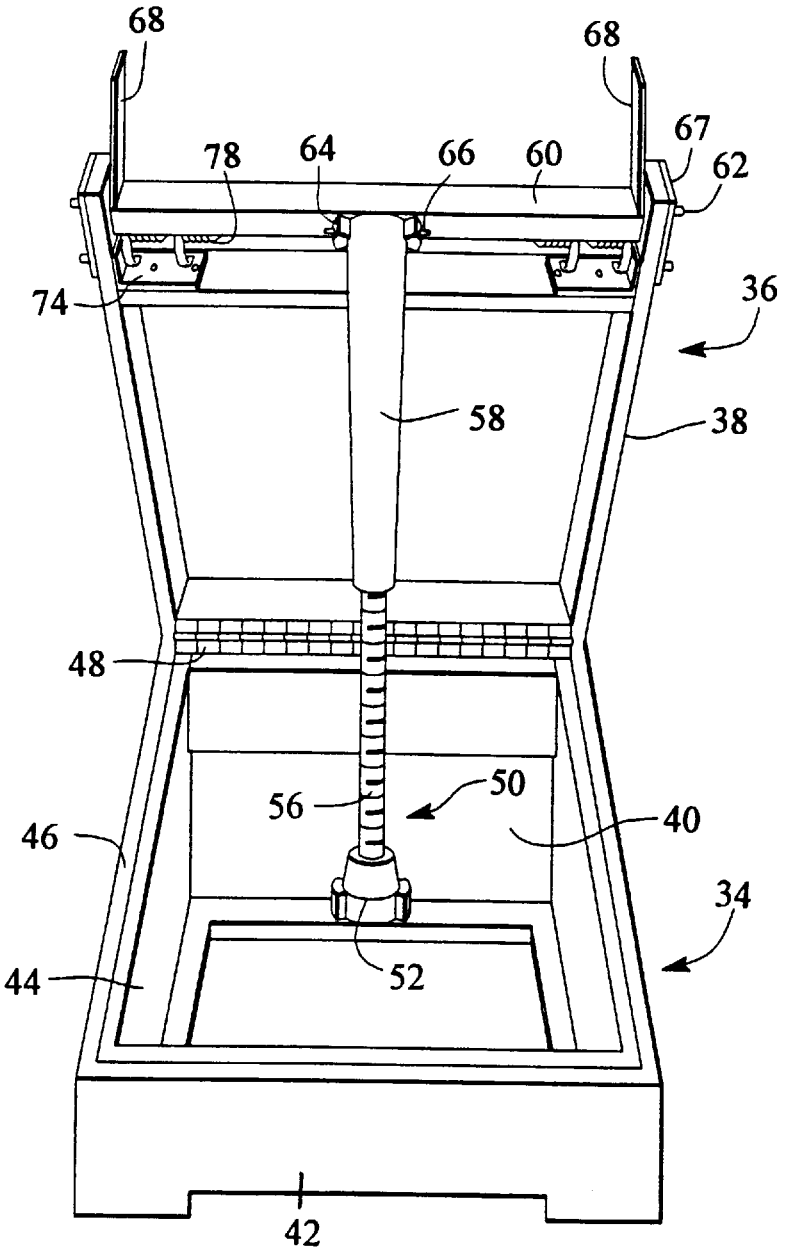
FIG. 3 illustrates a perspective view of the invention shown in FIG. 1.
Figure 4:
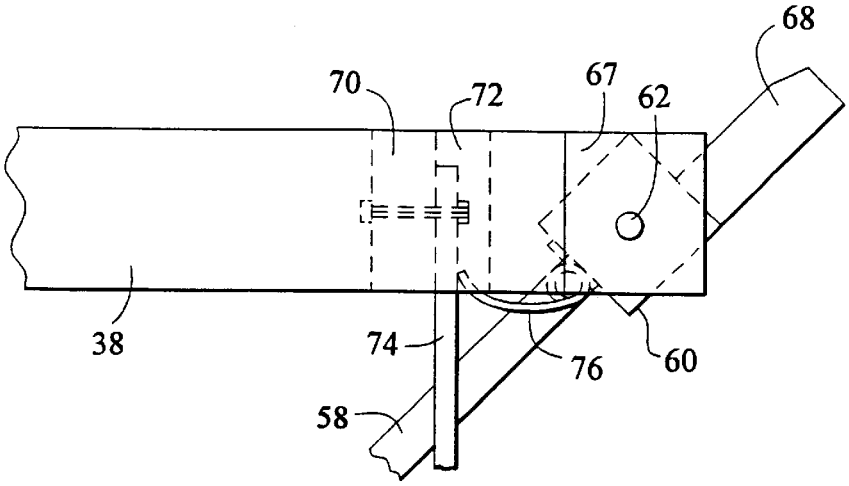
FIG. 4 illustrates a partial, close-up side view of the invention shown in FIG. 1.
Figure 5:
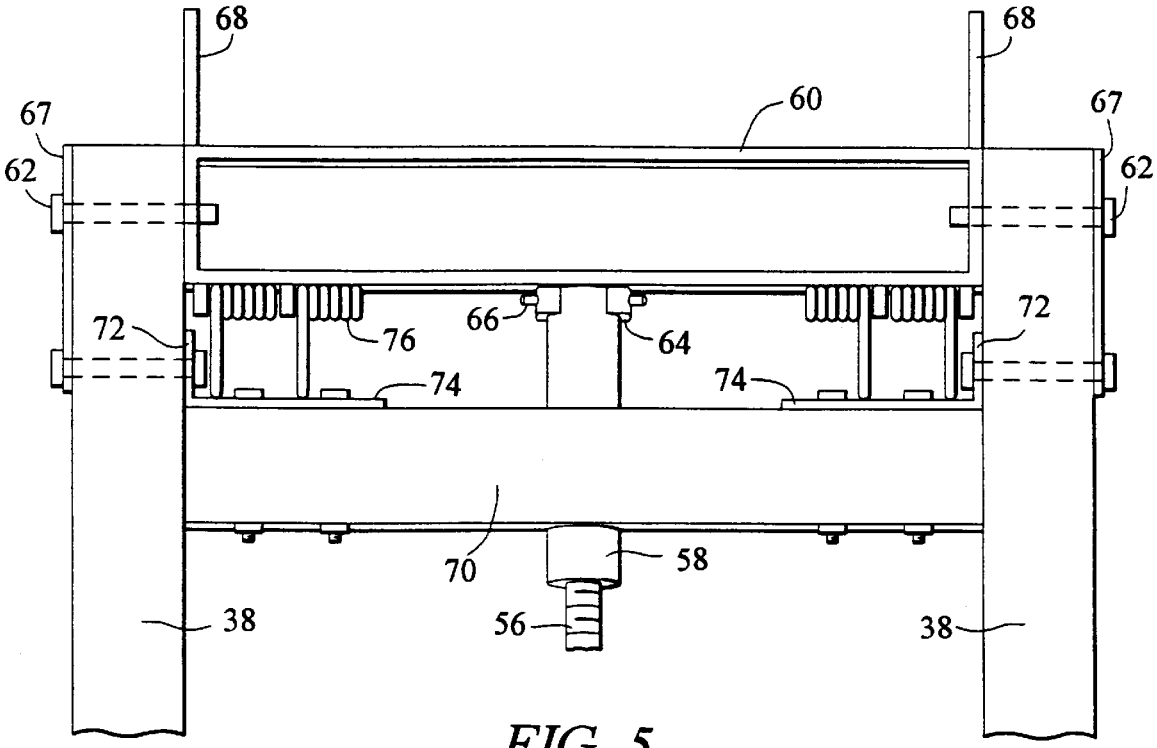
FIG. 5 illustrates a partial, close-up top view of the invention shown in FIG. 1.

While the invention can be used in relation with any type of furniture, it will be described hereinafter in the context of a reclinable, elevator lift chair as the preferred embodiment thereof.

Referring now to the figures, wherein like reference numerals refer to like elements, there is generally shown in FIGS. 1–5 a chair assembly 10 including a chair portion 12 which is comprised of a seat 14, spaced apart removable arms 16, and a removable back 20. The chair portion 12 further includes sides 22 that each extend below arms 16 and which terminate at bottom edges 26, rear edges 30, and front edge 32. The chair frame, to be discussed hereinafter, is typically constructed of wood, steel tubing, or the like covered with foam and fabric in a manner known in the art.

The chair portion 12 of lift chair apparatus 10 is able to move with respect to base portion 34 as the chair portion 12 is supported upon a sub-frame assembly 36. The sub-frame assembly 36 includes a pair of spaced apart longitudinally extending beams 38 and a rear transverse beam 39. In the preferred embodiment, the longitudinally extending beams 38 have removably carried thereby the arms 16 of the chair assembly 10.

Base 34 similarly includes front and rear walls 40,42 and sidewalls 44. The sidewalls 44 provide support surfaces 46 which may be inclined in construction wherein the front wall 40 is of equal width but greater height than rear wall 42. Preferably, the height of the front wall 40 exceeds that of the back wall 42 by approximately three (3) inches. The sub-frame 36 may be pivotally attached at pivot or hinge 48 to the base 34. The pivot 48 may be a piano hinge, for example, extending fully across the top of the front wall 40.

In the illustrated embodiment, the chair portion 12 of lift chair 10, including seat 14 and sides 22, are structurally attached to and move with the sub-frame 36. The sides 22 may be attached by bolts passing through beams 38 in a manner well known to those skilled in the art.

The lifting mechanism 50 is provided to pivot sub-frame 36 with respect to base 34 about pivot 48. A motor drive 52 can be affixed at pivot 54 to base 34, preferably in the proximity of front 40. The motor drive 52 includes a rotating threaded shaft 56 that extends from motor drive 52 upwardly to engage a ram 58. Ram 58 is a tubular sleeve having a longitudinal internally threaded bore. The internal threads of ram 58 engage the external threads of shaft 56 so that the threaded shaft 56, when rotated by motor drive 52, will cause the ram 58 to extend or retract accordingly. The movement of the ram 58 will similarly cause the sub-frame 36 to pivot upwardly or downwardly about pivot 48.

A first transverse beam 60 defines an attachment between ram 58 and.sub-frame 36. Transverse beam 60 is pivotally attached about pivot pins 62 to each of the side beams 38 through plate 67 attached to the outside of each beam 38. Gusset plates 64 extend from beam 60 with pivot pin 66 forming a pivotal connection between the ram 58 and the plates 64. The transverse beam 60 further includes brackets 68 extending therefrom to which the frame which supports back 20 is removeably attached in a conventional manner. Preferably, beam 60 comprises a 0.25 inch×2.5 inch×1.25 foot beam having a channel therein while pivot pins 62 are ⅜ inch steel pins and plates 67 have a 0.25 inch thickness.

The sub-frame 36 may also be equipped with a second transverse beam 70 which is fixed between side beams 38 by angle brackets 72 in proximity to beam 60. Attached by bolts or the like to beam 70 at either side thereof are downwardly extending steel plates 74, preferably 0.25 inch×6.5 inch×6 inch. Similarly, beam 60 may be provided at either end with flanges or brackets 76, attached on the same side of the beam 60 as plates 64, between which are mounted compression springs 78 for use in biasing the pivotally attached beam 60. Specifically, four springs are preferably used, two per side, where each spring has one end extending into contact with the underside of beam 60 and the other end extending into contact with the plates 74.

In operation, the reversible motor 52 may be caused to either drive ram 58 away from motor 52 or towards motor 52 depending upon the rotation given to shaft 56. When the motor 52 is caused to drive ram 58 outward, ram 58 pushes upon pivot pin 66 causing beam 60 to raise the back portion of sub-frame 36 about pivot point 48. This may continue until sub-frame 36 is positioned at such an incline relative to base 34 that the user is in a partially standing position. During this lifting procedure, the springs 76 act upon the beam 60 by biasing the beam against the rotation experienced about pivot points 62 as the ram 58 pushes against pin 66. The springs, therefore, function to keep the slack out of the movement allowing such movement to be smoother.

When the motor 52 is caused to pull ram 58 inward, ram 58 will pull on pivot pin 66 whereby the sub-frame 36 will follow beam 60 and pivot about hinge 48 until the underside of sub-frame 36 engages with the support surfaces of base 34. In this reclined position the back 20, supported upon brackets 68, continues to be somewhat upright in position. Once sub-frame 36 engages with base 34 the motor 52 may still cause ram 58 to be pulled inward by as much as two to three inches where the pivot connection point 66 will follow causing beam 60 to rotate about pivot pins 62. As beam 60 rotates, the back support 68 follows causing back 20 to assume a reclined position. In one embodiment the back may recline approximately 75 degrees from vertical with approximately 45 of those degrees being after the sub-frame has engaged with the base support surfaces. In another embodiment the back reclines to a position substantially horizontal to the plane on which the bottom of the chair base resides. In yet another embodiment the plane of engagement between the sub-frame and the base is substantially horizontal to the plane on which the bottom of the chair base resides and the chair seat and back are positioned substantially parallel to this plane in the fully reclined position. As the chair is raised from the fully reclined position, the back lifts first as the ram causes the beam 60 to rotate until a point is reached wherein further movement of the ram 58 raises the sub-frame from base 34. At this point the back is once again in a substantially upright position.

Figure 6:
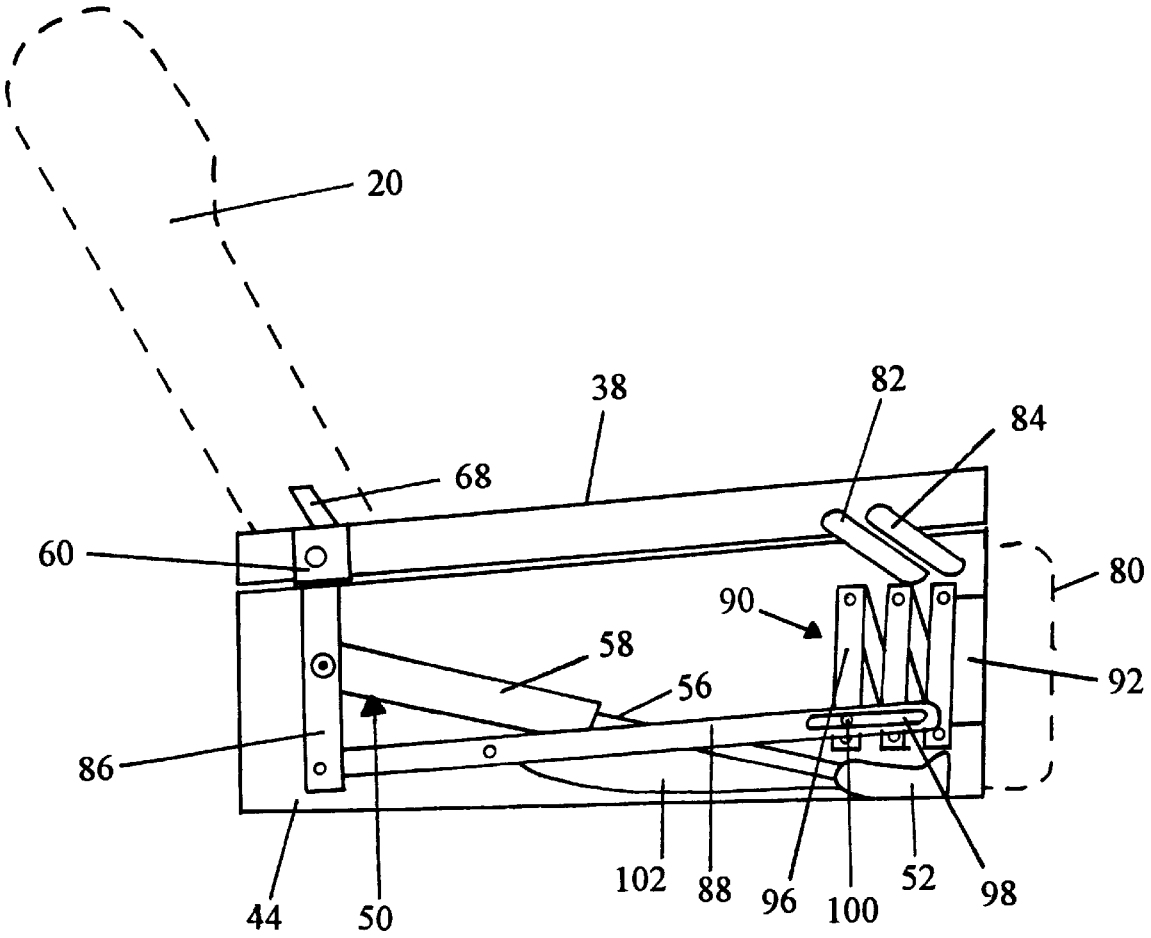
FIG. 6 illustrates a side view of a second embodiment of the present invention incorporating an elevatable ottoman attachment depicted in the lowered position.
Figure 7:
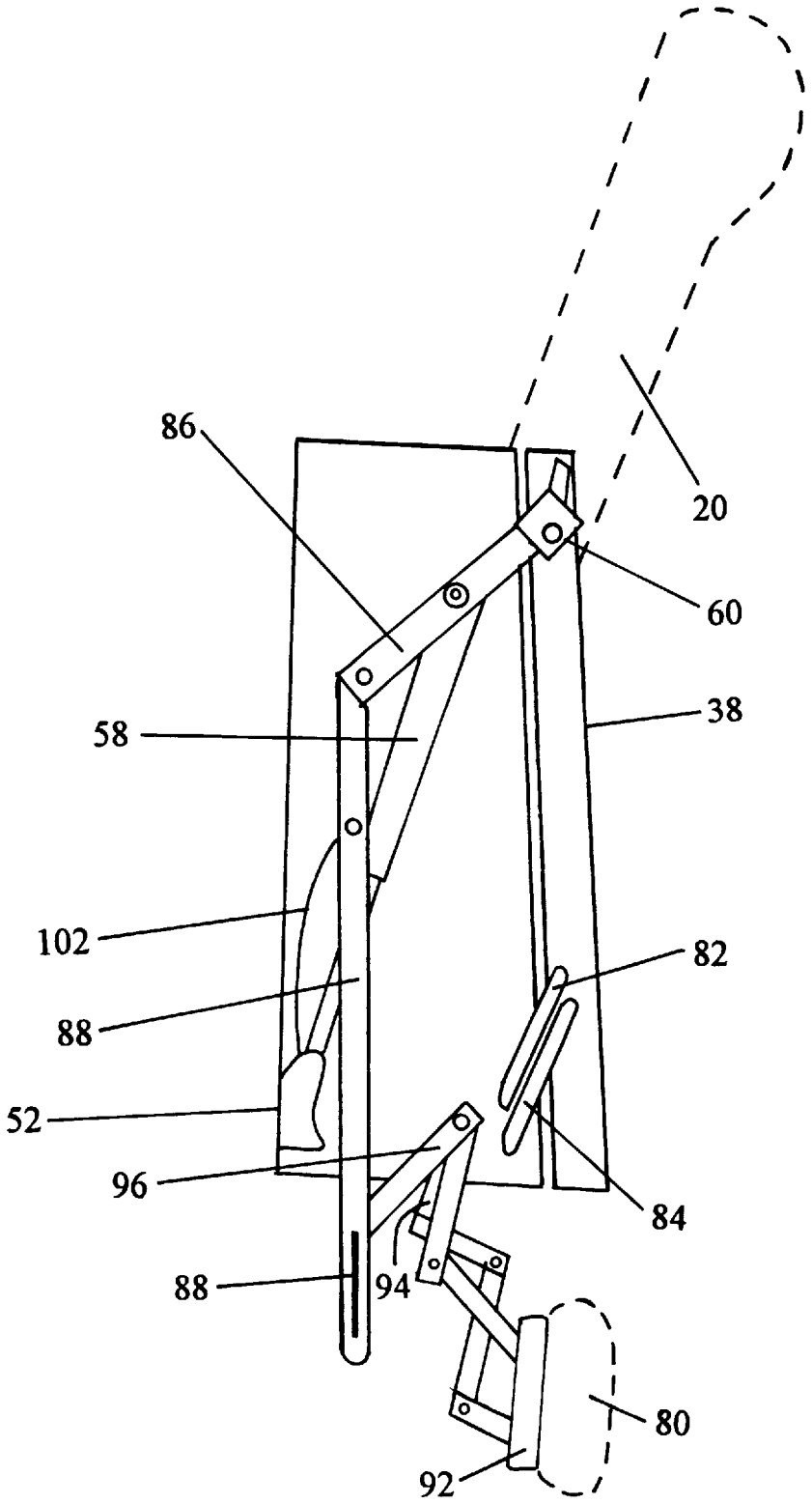
FIG. 7 illustrates a side view of the invention shown in FIG. 6 in which the ottoman attachment is depicted in the raised position.
Figure 8:
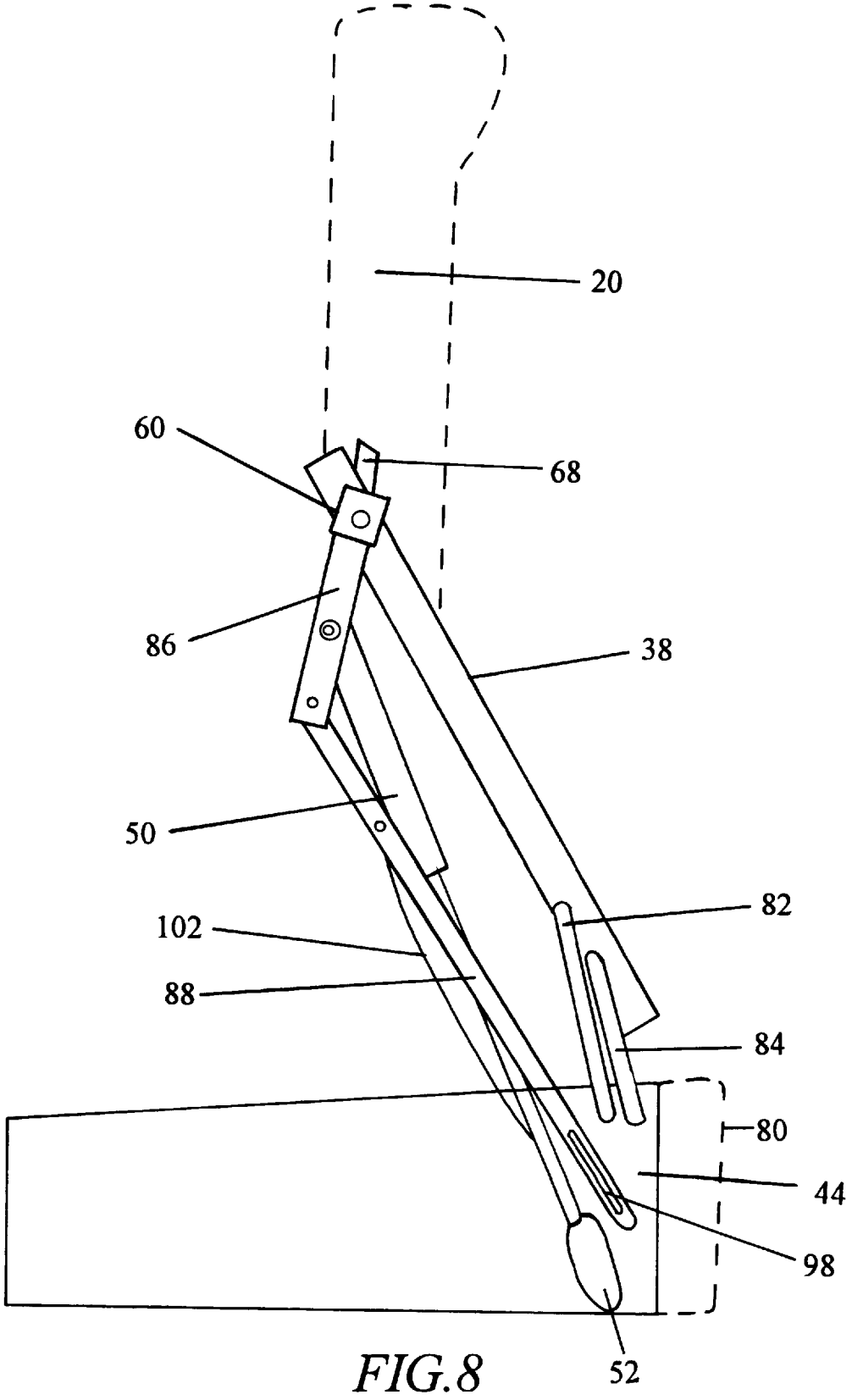
FIG. 8 illustrates a side view of the invention shown in FIG. 6 in which the elevator lift chair is depicted in the raised position with the ottoman linkage removed for the sake of clarity.

Turning to FIGS. 6–8, there is illustrated a second embodiment of the present invention which incorporates an optional, elevatable ottoman or foot rest 80. As before, the chair includes a chair portion, comprised of a seat, spaced apart arms, and back, supported by the sub-frame assembly which is again designed to move with respect to the base portion. In the present embodiment, the sub-frame is attached proximate to the front of the base at each side thereof by means of a pair of flat steel bars 82,84, preferably 10 gauge steel. More specifically, each of the steel bars 82,84 is pivotally connected at one end to one of the sides of the base and at the other end thereof to one of the longitudinally extending beams of the sub-frame. The front bar 84 will be shorter in length that the back bar 82. With this configuration, as the chair moves to attains its fully raised position, the steel bars 82,84 will cause the front of the sub-frame assembly to raise above the front of the base portion. This further raising of the sub-frame functions to aide the user in leaving the chair. The length and spacing of the bars 82,84 will determine how far the front of the sub-frame assembly moves with respect to the base. Similarly, any binding interaction caused by contact between the steel bars 82,84 will function to limit the movement of the sub-frame assembly relative to the base. It is also contemplated that one bar 82 could be used when provided with a corresponding stop positioned on either the sub-frame or base as required.

The lifting mechanism 50, comprising motor 52 pivotally attached to the base, shaft 56, and ram 58, is again provided to move the sub-frame assembly with respect to the front of the base. In the present embodiment, the ram 58 is attached to a steel bar 86 which is in turn attached at one end thereof to the transverse beam 60 and at the other end thereof to an ottoman drive bar 88. Meanwhile, the ottoman 80 is attached to the front of the base portion by a pair of scissor assemblies 90 positioned on each side of the base. Each of the scissor assemblies 90 comprises at its exterior end an ottoman support bracket 92 to which the ottoman is attached by bolts, screws, or the like. The interior end of each scissor assembly 90 comprises a first scissor link 94 which is pivotally mounted to a corresponding one of the side walls of the base and a second scissor link 96 which linked to the drive bar 88. Specifically, the drive bar 88 is provided with a slot 98 in which is disposed a rod, rivet, or bolt 100 associated with the scissor link 96.

During operation, the chair may be moved from its normal position to either a reclined position or a raised position through operation of the lifting mechanism 50. Specifically, to move the chair from it normal position, wherein the sub-frame rests upon the base and the angle of the back is reclined approximately 18 degrees from the vertical plane, towards the reclined position the ram 58 is caused, by the reversible motor 52, to draw the bar 86 forward which in turn causes the transverse beam 60, and the back portion of the chair attached thereto, to rotate backwards in a manner similar to that described with respect to the first embodiment of the present invention. As the ram 58 continues its inward movement, the bottom of the bar 86 will also be caused to move forward towards the front of the base where the back of the slot 100 in drive link 88 will be caused to engage the bolt 100 associated with second scissor link 96. Thereafter, any further inward movement of the ram 58 will cause the back of the slot 100 to moved the second scissor link 96 resulting in the expansion of the scissor assembly 90 and the corresponding raising of the ottoman 80. Preferably, the full extension of the scissor assembly 90 corresponds to the back of the chair achieving its fully reclined position. A return to the normal position from the reclined position is achieved by reversing this process. In addition, a spring (not shown) may be used to bias the scissor assembly 90 towards its retracted position to assist in lowering the ottoman 80 during this reverse process.

To move the chair from the normal position to the fully raised position, the motor 52 is caused to drive the ram 58 outward whereby the ram 58 is caused to push upward on the bar 86. The upward movement of the bar 86 is transferred to the transverse beam 60, in a manner similar to that described with respect to the first embodiment, such that the back of the chair is moved upward while maintaining a generally vertical orientation. During this process, the slot 100 in the drive bar 88 allows the bolt 100 associated with the second scissor link 96 to slide therein whereby the application of any pressure caused by the lifting process on the hardware associated with the ottoman may be avoided. In addition, a chain or cable 102 may be provided to connect the drive bar 88 to the front of the base for the purpose of ensuring that the back of the chair does not move substantially beyond the vertical plane during the raising procedure. Specifically, the cable 102 will function to arrest movement of the sub-frame assembly at the fully raised position wherein the transverse beam 60 positions the back support brackets 68 such that the back of the chair maintains a position substantially within the vertical plane. Such an arrangement is desirable to prevent the back of the chair from moving to far forward whereby the patient may be thrown from the chair during the lifting procedure.

It should be apparent from the preceding description that this invention has, among other advantages, the advantage of providing a chair movable between three unique positions, these positions being where the chair is fully lifted with the back substantially vertically aligned, the chair is reclined with the back slightly offset from vertical alignment, and the chair is reclined with the back substantially horizontal. Furthermore the invention has the advantage of providing an elevatable ottoman whereby the ottoman may be placed in substantial alignment with the seat and back when the chair is placed in the third position.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any equivalent thereof.

I claim:

1. A lift chair being movable between reclining and forward lifting positions, comprising:

a chair portion and a back portion;

a base member having a lower ground engaging surface that defines a first plane and an upper surface that defines a first mating surface;

a sub-frame assembly for supporting said chair portion having a front portion, a rear portion, and a second mating surface that is engagable with said first mating surface, said sub-frame assembly being movably connected to said base member proximate to said front portion;

a rotatable beam rotatably connected to said rear portion of said sub-frame assembly having a back support member to which said back portion is attached;

an ottoman associated with said base member movable between extended and retracted positions; and a motor associated with said base member and linked to both said rotatable beam and said ottoman for use in moving said sub-frame assembly relative to said base member, said rotatable beam, and said ottoman;

wherein said lift chair is movable between a first position wherein said sub-frame assembly is inclined forward relative to vertical, a second position wherein said second mating surface engages said first mating surface and said ottoman is in said retracted position, and a third position wherein said second mating surface continues to engage said first mating surface, said back portion is reclined rearwardly relative to vertical, and said ottoman is in said extended position.

2. The lift chair as recited in claim 1, wherein said third position further comprises said back portion and said ottoman being positioned in a second plane substantially parallel to said first plane.

3. The lift chair as recited in claim 1, wherein said first mating surface and said second mating surface engage in a second plane transverse to said first plane.

4. The lift chair as recited in claim 1, further comprising two pairs of flat bars wherein each flat bar of each pair is rotatably connected to a corresponding side of both said sub-frame assembly and said base member for allowing said front of said sub-frame assembly to be raised relative to said base member when said lift chair is placed in said first position.

5. The lift chair as recited in claim 1, wherein said ottoman is connected to said base member by a pair of scissor assemblies.

6. The lift chair as recited in claim 5, further comprising a first bar linked to said motor and connected at one end thereof to said rotatable beam and a drive bar connected at one end thereof to said first bar opposite said rotatable beam and at the other end thereof to at least one of said pair of scissor assemblies.

7. The lift chair as recited in claim 6, wherein said drive bar has a slot in which is slidably disposed a portion of said at least one of said pair of scissor assemblies.

8. A lift chair being movable between reclining and forward lifting positions, comprising:

a chair portion and a back portion;

a base member having a lower ground engaging surface that defines a first plane and an upper surface that defines a first mating surface;

a sub-frame assembly for supporting said chair portion having a front portion, a rear portion, and a second mating surface that is engagable with said first mating surface;

a pair of flat bars each rotatably connected to a corresponding side of both said sub-frame assembly and said base member proximate to said front portion of said sub-frame assembly for allowing said sub-frame assembly to be moved relative to said base member;

a rotatable beam rotatably connected to said rear portion of said sub-frame assembly having a back support member to which said back portion is attached; and a motor associated with said base member and linked to said rotatable beam for use in moving said sub-frame assembly relative to said base member and for causing the rotation of said rotatable beam;

wherein said lift chair is movable between a first position wherein said sub-frame assembly is inclined forward relative to vertical and spaced from said base member, a second position wherein said second mating surface engages said first mating surface, and a third position wherein said second mating surface continues to engage said first mating surface and said back portion is reclined rearwardly relative to vertical.

9. The lift chair as recited in claim 8, further comprising an ottoman associated with said base member and linked to said motor, said ottoman being movable between extended and retracted positions.

10. The lift chair as recited in claim 9, wherein said ottoman is in said retracted position when said lift chair is in said first and second positions and in said extended position when said lift chair is in said third position.

11. The lift chair as recited in claim 10, wherein said ottoman and said back portion occupy a second plane substantially parallel to said first plane when said lift chair is in said third position.

12. The lift chair as recited in claim 8, wherein said second mating surface is disposed in a second plane transverse to said first plane.

13. A lift chair being movable between reclining and forward lifting positions, comprising:

a chair portion and a back portion;

a base member having a lower ground engaging surface that defines a first plane and an upper surface that defines a first mating surface;

a sub-frame assembly for supporting said chair portion having a front portion, a rear portion, and a second mating surface that is engagable with said first mating surface;

two pairs of flat bars, each flat bar of each pair being rotatably connected to a corresponding side of both said sub-frame assembly and said base member proximate to said front portion of said sub-frame assembly, for allowing said sub-frame assembly to be moved relative to said base member;

a rotatable beam rotatably connected to said rear portion of said sub-frame assembly having a back support member to which said back portion is attached; and a motor associated with said base member;

a first bar linked to said motor having one end connected to said rotatable beam;

an ottoman, movable between retracted and extended positions, mounted to said base member by a pair of scissor assemblies; and a second bar connected at one end thereof to said first bar opposite said rotatable beam and at the other end thereof to at least one of said scissor assemblies, said second bar further having a slot in which is slidably disposed a portion of said at least one of said scissor assemblies;

wherein said motor is used to move said lift chair between a first position wherein said sub-frame assembly is inclined forward relative to vertical and spaced from said base member and said ottoman is in said retracted position, a second position wherein said second mating surface engages said first mating surface and said ottoman is in said retracted position, and a third position wherein said second mating surface continues to engage said first mating surface, said back portion is reclined rearwardly relative to vertical, and said ottoman is in said extended position.

14. The lift chair as recited in claim 13, wherein said first mating surface is disposed in a second plane transverse to said first plane.

15. The lift chair as recited in claim 13, wherein said back portion and said ottoman are disposed in a second plane substantially parallel to said first plane when said chair is in said third position.

* * * * *